United States Patent [19]

Agcaoili

[11] 4,256,164

[45] Mar. 17, 1981

[54] SLIDABLE DOOR STRUCTURE

[75] Inventor: Clarito R. Agcaoili, Glendale Heights, Ill.

[73] Assignee: Efron, Incorporated, Chicago, Ill.

[21] Appl. No.: 971,657

[22] Filed: Dec. 21, 1978

[51] Int. Cl.[3] ..... E05D 15/50

[52] U.S. Cl. ..... 160/186; 160/196 R

[58] Field of Search ..... 160/186, 196 R

[56] References Cited

U.S. PATENT DOCUMENTS

| | | | |
|---|---|---|---|
| 3,102,581 | 9/1963 | Kochanowski | 160/196 R |
| 3,304,993 | 2/1967 | Fox-Williams | 160/187 |
| 3,418,666 | 12/1968 | Rockey | 160/186 |
| 3,441,076 | 4/1969 | Glejf | 160/196 R |
| 4,014,377 | 3/1977 | Kochanowski | 160/196 R |

*Primary Examiner*—Peter M. Caun

*Attorney, Agent, or Firm*—Merriam, Marshall & Bicknell

[57] ABSTRACT

A slidable door structure adapted to move on tracks wherein one or more glide assemblies are used to resiliently mount the door. The glide assembly includes a glide body and a retention member with a spring means disposed between the two bodies. A snap fastener serves to hold the glide assembly in position so that the retention member is maintained in a fixed position while the glide body moves vertically relative to the door structure. The invention also includes an improved mullion structure and a locking device for locking and maintaining the door in an open position. Further, a substantially leak-free connection is provided between the door and wall jamb.

21 Claims, 11 Drawing Figures

SLIDABLE DOOR STRUCTURE

This invention relates to an improved structure for resiliently mounted slidable doors adapted to move on tracks, and more particularly relates to a new and improved structure for mounting the doors on said track and an improved locking device for locking the door in a desired position along the track. Further, the present invention provides for an improved mullion structure for slidable door structures.

BACKGROUND OF THE INVENTION

Resiliently mounted slidable doors adapted to move along tracks or rails are shown in the prior art. See for example U.S. Pat. No. 4,014,377, 4,014,378, and 3,102,581 which illustrate doors of this type commonly used as enclosure doors for showers and tubs. Unfortunately, a number of problems exist with respect to resiliently mounted slidable doors presently available. There are installation problems with glide assemblies used to mount the door on the tracks. In one instance, the spring used in the glide assembly must be attached to a panel tab as shown and illustrated in U.S. Pat. No. 4,014,378. It has been found that this arrangement is not satisfactory inasmuch as the spring means will sometimes slip out of the assembly during the course of installation.

Additionally, certain prior art slidable door installations require that a portion of the glide assembly be located on one side of the panel and a retention clip or member be positioned on the opposite side of the panel. In some cases, the need to place a portion of the glide assembly on one side of a panel and the retention clip on the opposite side of the panel has been found unsatisfactory as the installation is too time consuming inasmuch as it requires an installer to work on opposite sides of a panel in order to assemble the glide assembly.

Other problems exist with certain conventional slidable door assemblies in that the panel or mullions are not sufficiently rigid such that when the door structure is in a closed position, the panels are not properly aligned but rather are twisted relative to one another which is undesirable.

Further, it has been found that some slidable door assemblies presently available, which are used as door structures for tub and shower enclosures, fail to provide a substantially watertight seal between the closure mullion and the adjacent wall or wall jamb.

What is desired is a slidable door structure having glide assemblies which permit a slidable door to be readily installed on appropriate tracks. It is further desired to install the glide assembly on one side of the panel or mullion with only a small fastener means being located on the opposite side of the panel. Moreover, it is desired to have mullions which are sufficiently rigid so that the desired mullion alignment is achieved particulary when the door is in an open position and the mullions are contiguous to each other. It is also desired to have a mullion which eliminates the need for a spring retaining tab or glide assembly elongated panel opening presently found in available panel structures. It is also desired to have a slidable door structure which provides a substantially watertight seal between the wall jamb and closure mullion to preclude water from spilling on to the floor.

SUMMARY OF INVENTION

The invention disclosed and claimed herein serves to obviate the problems found with slidable door structures presently available. The door structure disclosed and claimed herein utilizes an improved mullion structure and glide assembly which obviates the need for any elongated openings or tabs in the mullions. Further, the glide assembly employed with the slidable door structure set forth herein is relatively easy to install and obviates the need for placing a prior art retention clip on the side of the panel opposite the glide body. Instead, the entire glide assembly disclosed and claimed herein can be put together and inserted in a mullion. The assembly is completed merely by inserting a snap-type fastener through the mullion and into the retention member. The need for placing a spring on a mullion tab and for placing a glide body on one side of the mullion is eliminated. Further, the substantially rigid mullion structure of the present invention allows the glide assemblies to be easily inserted in the mullion. Additionally, substantially uniform alignment of the mullions is achieved when the door is in an open position because of the mullion structure employed with the present invention.

A substantially watertight seal between the wall jamb and closure mullion is also provided.

Further, an improved track locking device to maintain the door in an open, locked position has been provided.

Briefly the invention disclosed and claimed herein relates to a slidable door closure in which channel-shaped mullions are employed between collapsible, plastic panel door members. The channel-shaped mullions provide for a substantially rigid construction so that when the door is opened, the mullions will be in a substantially aligned position which is particularly desirable.

In the present invention, glide assemblies serve to connect the door structure to tracks whereby the door structure is slidable in the tracks. The glide assemblies comprise a glide body which has a roller means projecting from one side of the body. A shank extends outwardly from the opposite side of the glide body. A spring means and a retention member are assembled to the glide body after which the completed assembly is inserted into one end of a channel-shaped mullion until the retention member seats against the mullion end. A rivet-type fastener member is inserted through a hole in the mullion and fastens to the retention member whereby the retention member is maintained in a fixed position on the mullion while the glide body and roller means are adapted to move vertically relative to the mullion.

A unidirectional track locking device which includes a plunger, a plunger housing and an end cap housing can be inserted in a channel-shaped mullion of the present invention and maintained in position by the glide assembly retention member extension.

In those instances where a watertight seal is required, as for example, when the application involves a slidable shower or tub door structure, a wall jamb can be supplied with a flange extending substantially along the entire length of the jamb. When the door structure is closed, the closure mullion will abut the wall jamb to provide a substantially watertight seal between the wall jamb and closure mullion.

BRIEF DESCRIPTION OF THE DRAWINGS

The invention will be better understood from the detailed description thereof, taken in conjunction with the accompanying drawings, in which.

DETAILED DESCRIPTION

Figure 1:
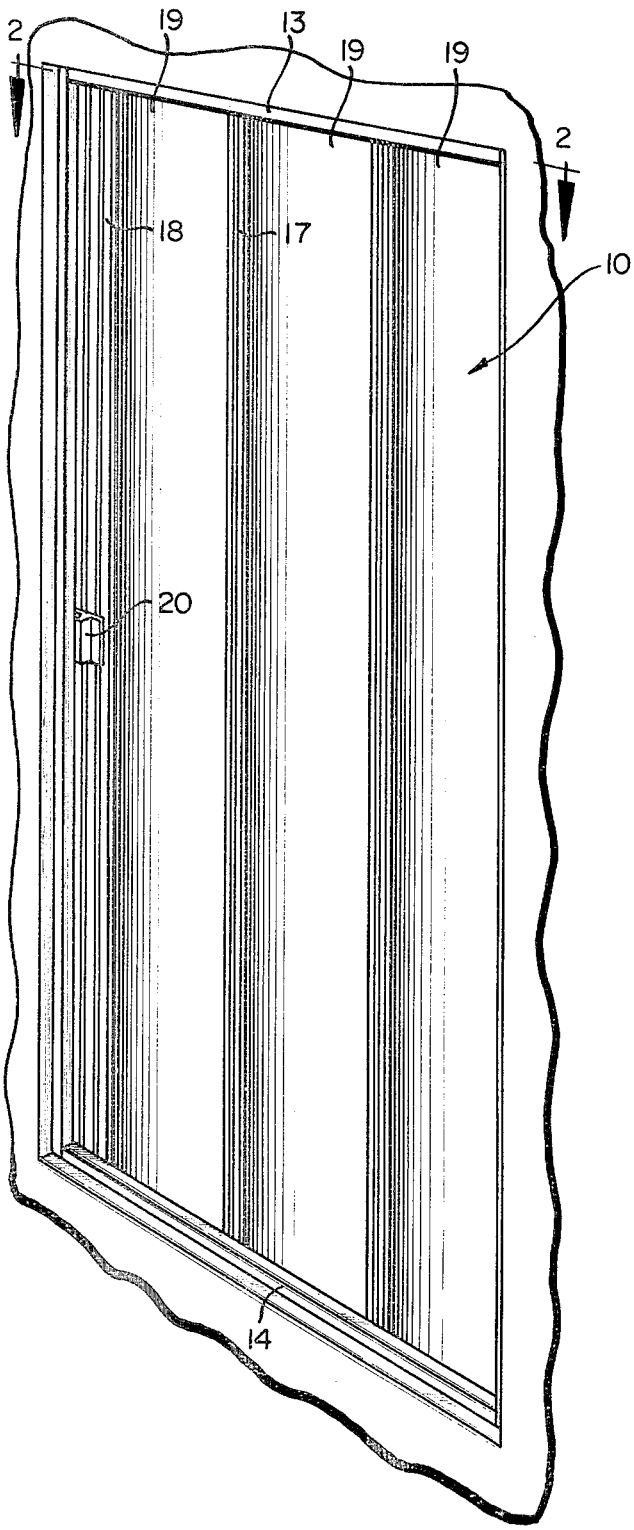
FIG. 1 shows a partial perspective view of the slidable door structure of the present invention in a closed position as used for a shower door installation.

Referring to the drawings, there is shown a flexible, slidable door structure 10 mounted on the outside of a shower enclosure to form a closed enclosure. Door 10 is mounted on a frame which comprises upright frame members or wall jambs 11 and 12 on opposite sides of the door and parallel upper and lower horizontal tracks 13 and 14 at the upper and lower ends of the door.

Figure 2:
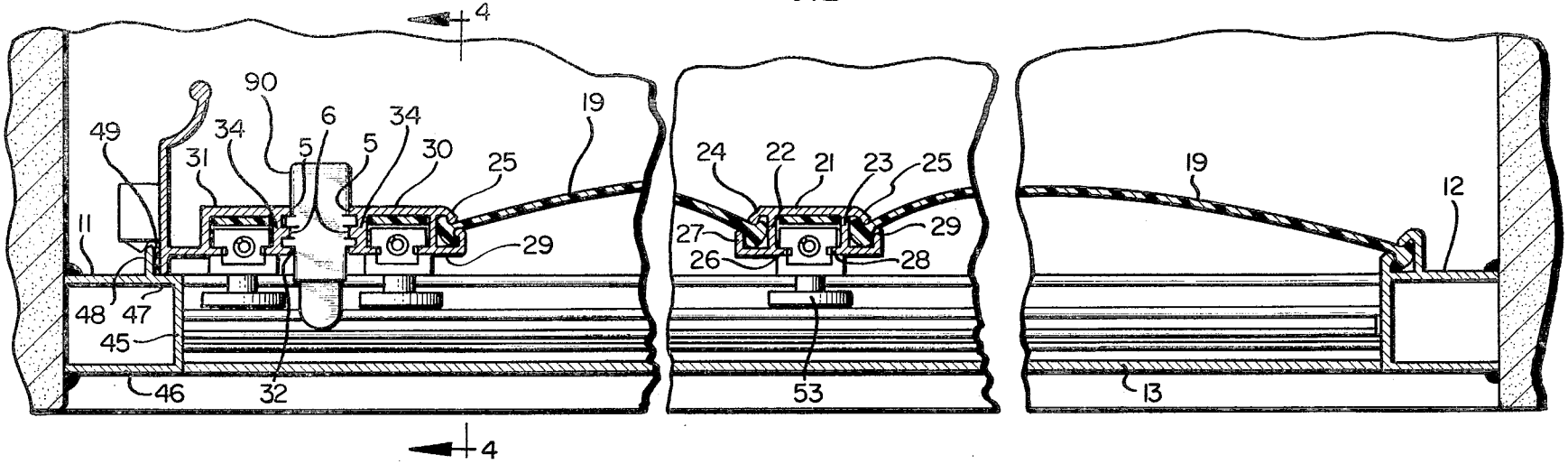
FIG. 2 shows a plan fragmentary section view of the slidable door structure as taken along lines 2—2 of FIG. 1.
Figure 3:
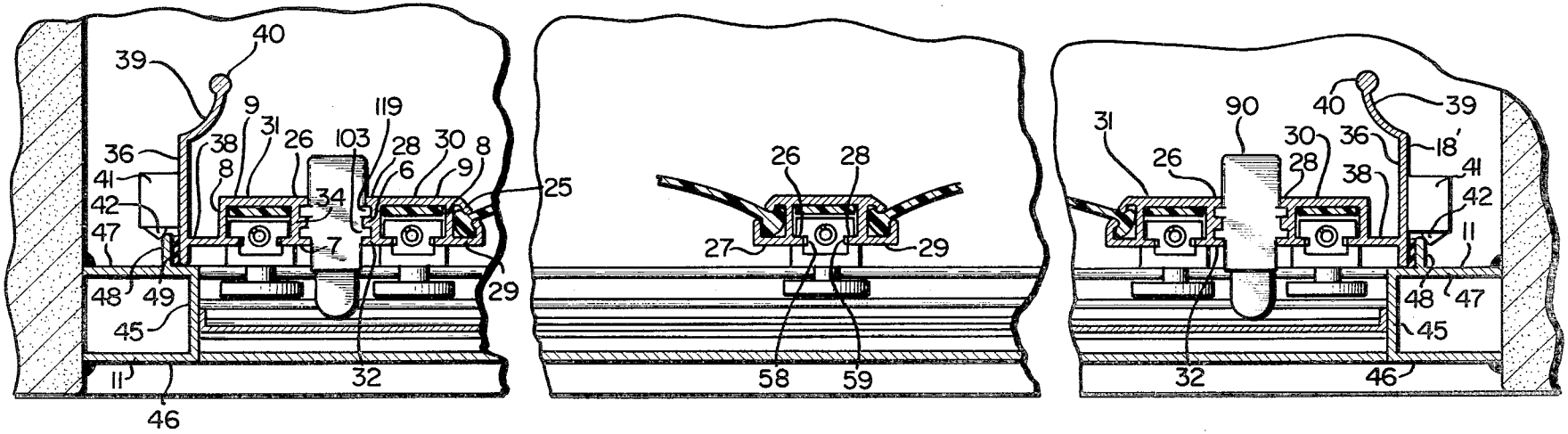
FIG. 3 shows a fragmentary plan view similar to that of FIG. 2 except that closure mullions are employed at both ends of the door structure so that the door structure can be opened at either end as opposed to the structure of FIG. 2 wherein the door structure can be opened from one end only.

The door 10 comprises alternate, vertically extending elongated mullions 17 and an end closure mullion 18 located at the open end of the door 10. As shown in FIGS. 1 and 2, the opposite door end is fixed to wall jamb 12. It is appreciated, however, that closure mullions could be employed at each end of the door so that the door can be opened or closed from either end. This door structure embodiment is illustrated in FIG. 3 where end closure mullions 18 are located at each end of slidable door 10.

Flexible panel members 19 made of polyethylene or some other suitable material are attached to mullions 17 and 18.

A handle 20 is mounted on the outside of closure mullion 18 so that the door can be opened and closed as required.

Mullions 17 preferably are substantially rigid members constructed of extruded aluminum or other suitable material. Each of the mullions which extend from the top to the bottom of the door, are channel shaped and, as shown in FIGS. 2 and 3 comprise a basewall 21 and sidewalls 22 and 23 that extend outwardly from basewall 21. Basewall 21 includes basewall flange 24 and 25. Sidewall 22 has an inner sidewall flange 26 and an outer sidewall flange 27. Sidewall 23 has an inner sidewall flange 28 and an outer sidewall flange 29. As seen in FIG. 2, a bead located at one edge of a flexible panel 19 is inserted and maintained in the space or groove formed by basewall flange 24 and outer sidewall flange 27 and a bead located at the opposite edge of the flexible panel 19 is inserted in an adjacent mullion and maintained in position in the space or groove formed by base flange 25 and outer sidewall flange 29.

The end closure mullion 18 includes two channel-shaped members 30, 31 separated by an inverted channel-shaped member 32. Channel members 30, 31 include basewalls 9 and outer sidewalls 8. An outer sidewall flange 29 and basewall flange 25 extend from sidewall 8 of channel member 30 in the manner previously described and shown for the comparable flanges on mullion 17.

Channel-shaped member 32 includes basewall 7 and sidewalls 34 which connect channel members 30, 31 to channel member 32. Sidewalls 34 each have a first and second flange 5, 6 extending inwardly into the channel to form recesses 3 and 4.

Channel member 31 which is adapted to seat against a wall jamb includes a bumper wall 36 which is spaced from channel sidewall 37 by strip 38. Wall 37 includes an extension 39 having bead 40 at the outboard edge thereof. Extension 39 serves as an inner handle for opening and closing door 10 from inside the enclosure. A conventional locking device 41 having a latch 42 is affixed to bumper wall 36.

Wall jamb 11 includes an outer wall 45 and front and back walls 46, 47. A strip 48 extends outwardly from the back wall 47 of the wall jamb. When door 10 is closed, bumper wall 36 abuts strip 48 to provide a substantially watertight seal between the wall jamb 11 and the closure mullions 18. If desired, a flexible sealing member presently available in the market place can be placed on wall 36 or strip 48 to assist in providing a positive seal between the closure mullion and wall jamb when door 10 is closed and lock 41 causes latch 42 to catch to jamb 11. This arrangement is shown in FIGS. 2 and 3 where sealing strip 49 is fixed to wall strip 48.

Figure 4:
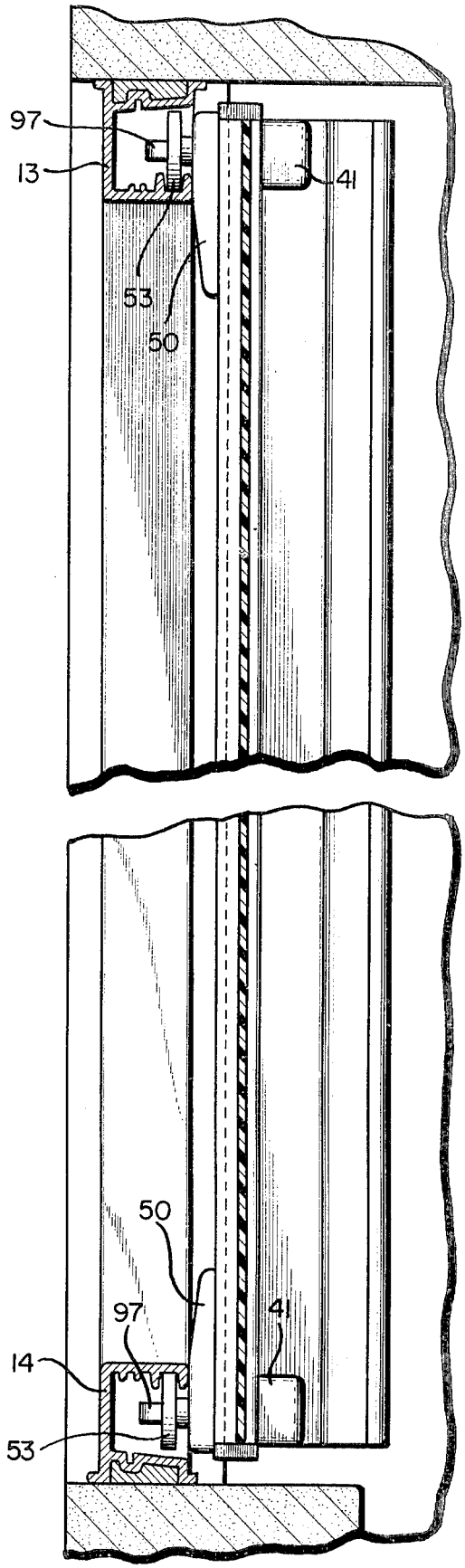
FIG. 4 shows a fragmentary vertical section view of the slidable door structure of the present invention taken along lines 4—4 in FIG. 2.
Figure 6:
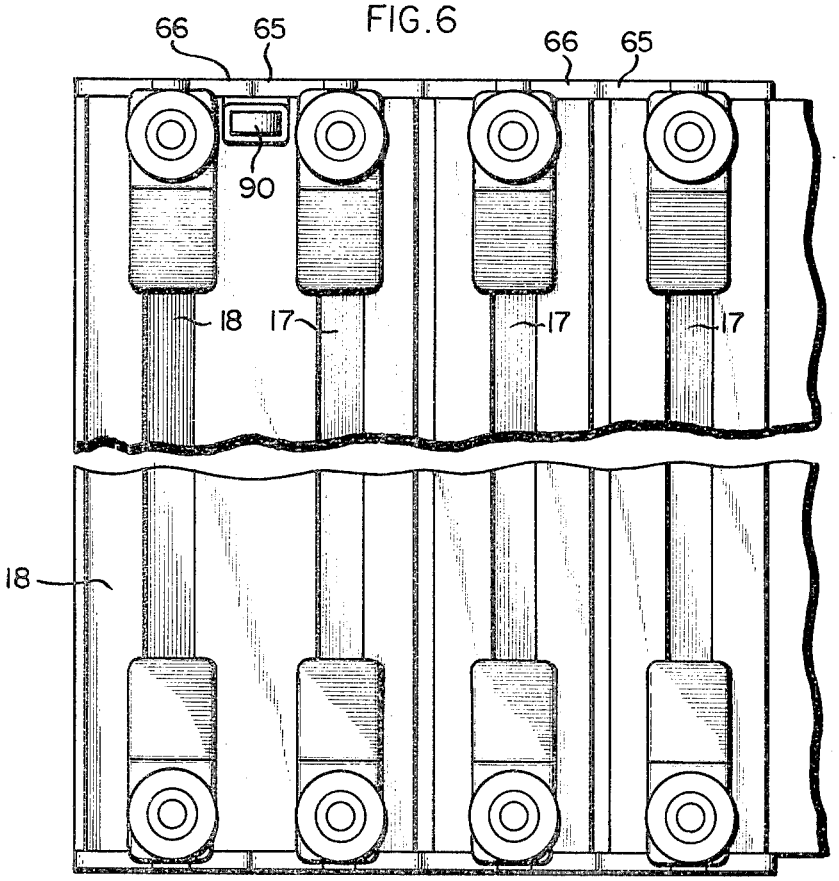
FIG. 6 shows a fragmentary, vertical view of the door structure shown in the closed position of FIG. 5.

The door structure 10 is mounted on upper and lower tracks 13 and 14 by means of glide assemblies 50 located at the top and bottom of the door structure as seen in FIGS. 4 and 6. Each glide assembly includes a glide body 51, an integral shank 52 and roller 53. The shank 52 is integral with and extends laterally outwardly from one side of the glide body. Roller 53 extends laterally outward from the opposite side of glide body 51 and includes a hub 54 which serves to space the wheel portion of the roller from the glide body. Roller 53 is rotatably mounted on body 51 by a rivet 55 which extends through the glide body and into the hub. Glide body 51, shank 52 and roller 53 preferably comprise a one-piece plastic molded construction.

Figure 10:
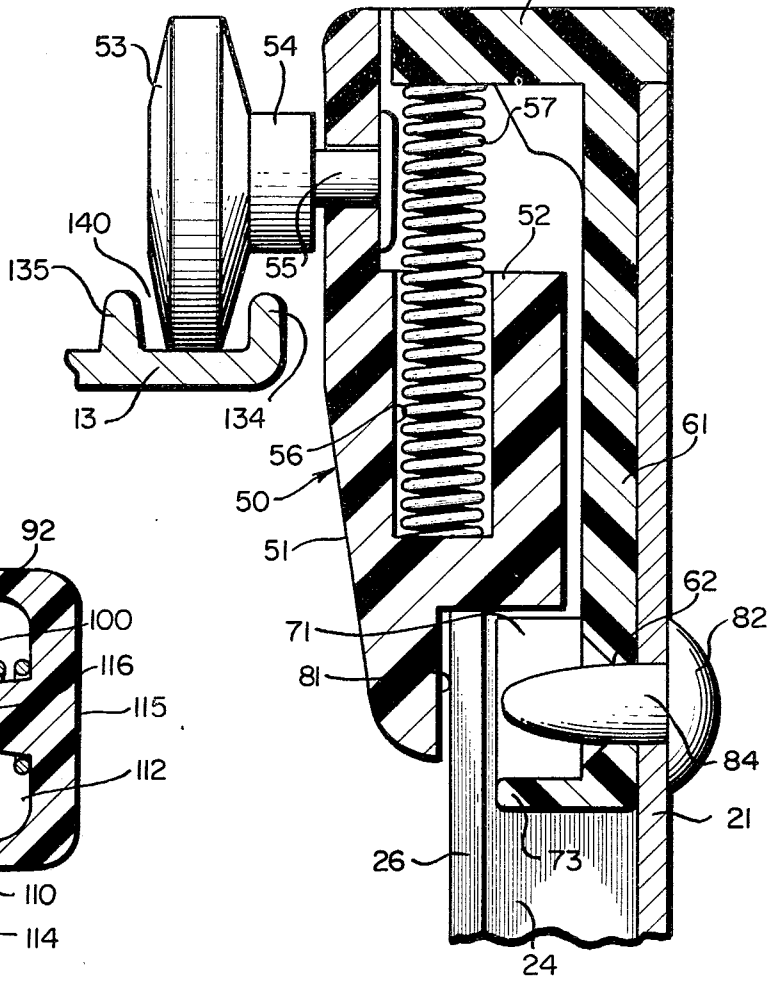
FIG. 10 shows a partial, vertical, section view of an assembled and installed glide assembly; and, FIG. 11 shows a fragmentary, vertical section view of the track locking device of the present invention as installed relative to the top track of the frame in which the door structure is resiliently mounted.

A longitudinal bore 56 is provided in shank 52 to receive a compression spring 57 which is adapted to seat in the bore as seen more clearly in FIG. 10. Shank 52 is also recessed on each side at 58, 56 as seen in FIG. 3. The recesses are of a thickness slightly in excess of the thickness of the inner sidewall flanges 26 and 28 on the channel members adapted to receive a glide assembly 50.

Figure 5:
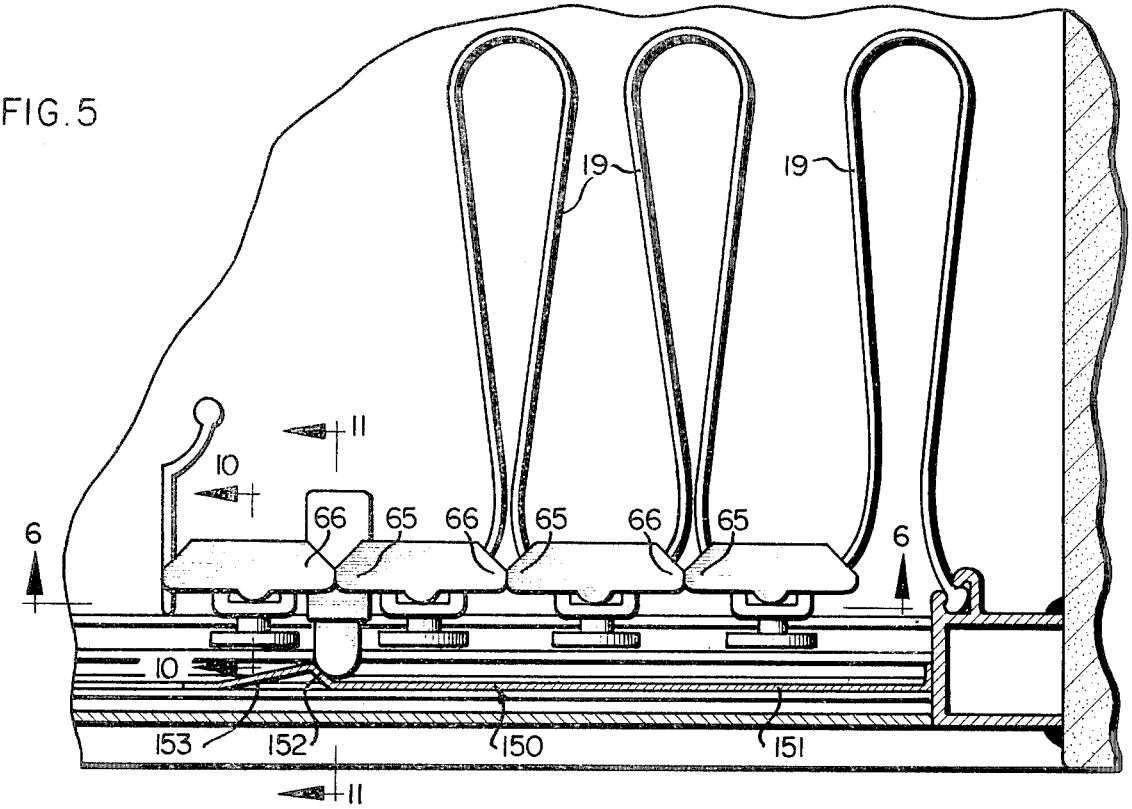
FIG. 5 shows a fragmentary plan section view of the slidable door structure of the present invention with the door in an open, locked position.

Retainer member 60, which is adapted to co-act with glide body 50, comprises an elongated strip member 61 having a hole 62 therein located contiguous to one end of member 61. Extension 63 is integral with and projects outwardly from the remaining end of member 60. Extension 63 includes stop arms 65 and 66 which are adapted to seat on the top and bottoms of the mullions 17 and 18. The arm 65, 66 are each of a length sufficient to have the arm extend beyond the channel member sidewall and flanges of the mullions 17 and 18 so that when door 10 is closed as shown in FIGS. 5 and 6, arms 65 and 66 of adjacent retention members 60 contact each other to preclude the mullions 17 and 18 from contacting one another.

A glide body stop member 70 is located at the end of retention member 60 near opening 61. Member 70 comprises sidewalls 71 and 72 and bottom wall 73, all of which extend laterally outward from elongated member 61.

In assembling a glide assembly, spring 57 is inserted in bore 56. Retention member 60 then is placed against glide body 51, FIGS. 7 and 10, and the glide assembly is inserted into either the top or bottom end of a channel in mullion 17 or 18 until the arms 65 and 66 of extension 63 abut against an end of the mullion. The top end of spring 57 seats against the bottom face of extension 63. When the glide assembly is in place in mullion 17 and 18, a snap fastener 82 is inserted through fastener opening 80 located in the channel basewall to lock and maintain glide assembly 50 in position on the mullion.

It is appreciated that the retaining member 60 of glide assembly 50 could be fixed to the mullion by other means than the use of fastener 82. If desired, an adhesive could be utilized to fix the retention member to a channel basewall. Further, while fastener 82 is shown in the drawings as being inserted into the retention member from the back side of the mullion, the retention member strip 61 could extend below the glide body stop means 70 and a fastening means could be inserted through the retention member from the front side of the channel basewall.

In the course of assembling the glide assembly, inner sidewall flanges 26 and 28 will be inserted in recesses 58 and 59 and face 81 of glide body 51 will seat against the front of inner sidewall flanges 26 and 28.

Fastener 82 is preferably made of a plastic material and includes a head 83 adapted to seat against basewall 21 and a shank 84. Shank 84 is of a thickness sufficient to provide a pressed fit between shank 84 and retention member opening 62.

Glide body 51 is adapted to move vertically relative to the mullion 17 and 18. When the body moves upward, spring 57 will be compressed and when the body returns to its normal position, the bottom of shank 52 will seat against sidewalls 71 and 72 of stop member 70.

Track loop assembly 90 includes a plunger 91, a compression spring 92, a plunger housing 93 and end cap housing 94.

Plunger 91 compresses a plunger body 96 having a plunger arm 97 extending outwardly therefrom. Body 96 has a bore 160 therein adapted to receive one end of compression spring 92.

Figure 9:
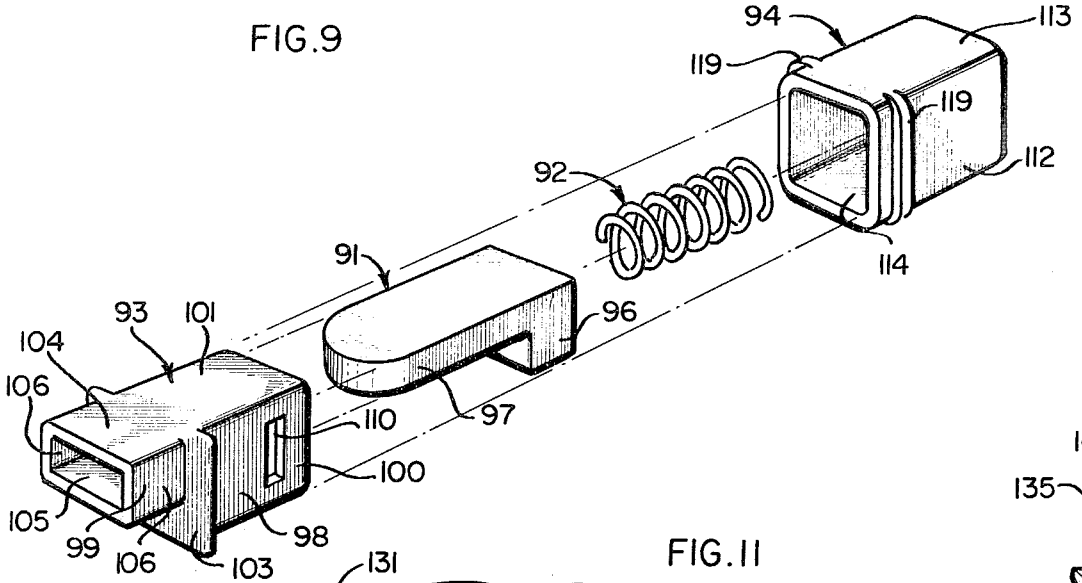
FIG. 9 shows the lock device of the present invention in a disassembled condition.
Figure 11:
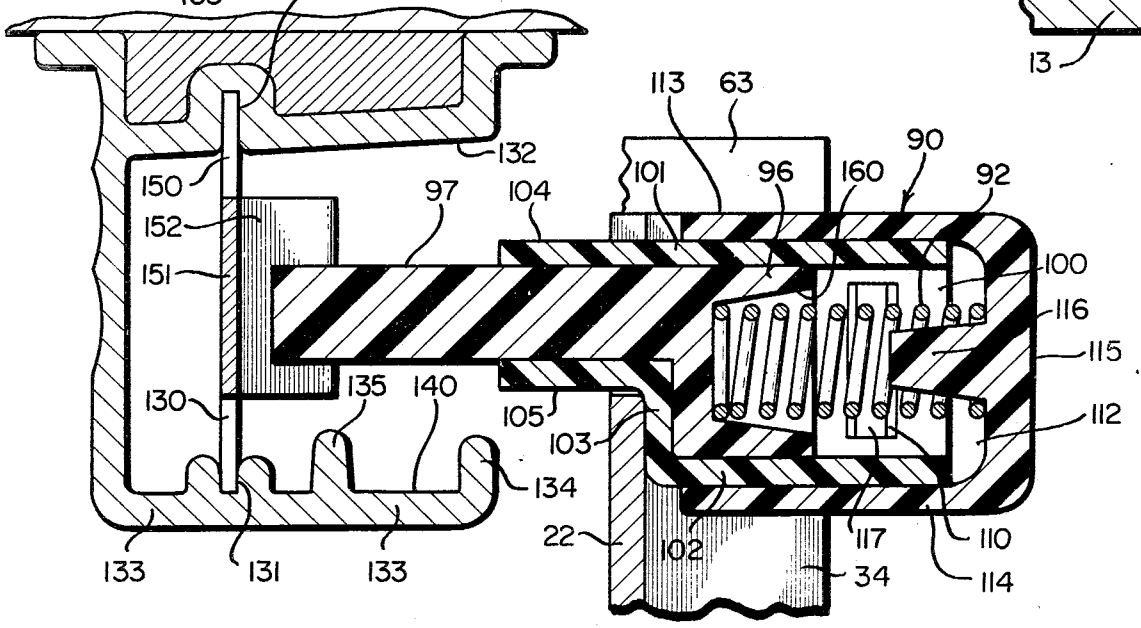

As seen in FIGS. 9 and 11, plunger 91 is adapted to fit within plunger housing 93 which includes a first housing section 98 and an integral second housing section 99 which projects outward from housing section 98. First housing section 98 includes a pair of sidewalls 100 and a top and bottom wall 101, 102 connected to the sidewalls. Section 98 is open at one end. End wall 103 is located at the remaining end of housing section 98. Wall 103 projects laterally outward beyond the sidewalls 100. Wall 103 has an opening therein which is slightly larger than the thickness of plunger arm 97 so that the plunger arm can pass through end wall 103. Each of the sidewalls 100 is slotted at 110.

The second housing section 99 is opened at both ends and includes a top wall 104 which is co-extensive with top wall 101. Section 99 also comprises bottom wall 105 with the top and bottom walls being connected together by spaced sidewalls 106. The distance between the bottom and top walls of section 99 is slightly greater than the thickness of plunger arm 97 so that when arm 97 is inserted in plunger housing 93, plunger arm 97 can only move horizontally and is restricted in its movement in any other direction.

End cap housing 94 includes sidewalls 112 which connect top and bottom walls 113 and 114. Housing 94 is open at one end and capped by end wall 115 at the remaining housing end. A boss 116 is located on the inside face of end wall 115 and is adapted to receive one end of spring 92 as shown in FIG. 11.

The inner face of each of sidewalls 112 has a projection 117 (FIG. 11) extending therefrom which is adapted to fit within slot 110.

Projections 119 extend from the outer face of each sidewall 112, the projections each being of a thickness which is slightly less than the distance between the sidewall flanges 5 and 6 on sidewalls 34.

Track lock assembly 90 is assembled by inserting plunger 91 into plunger housing 93. One end of spring 92 is placed in bore 160 and the remaining spring end is seated on boss 116 of end cap housing 94. Housing 94 is pushed onto plunger housing 93 thereby slightly compressing spring 92. Housing 94 is passed over housing 93 until projections 117 pass through slots 110 thereby completing the assembly. Preferably locking device 90 is made of a suitable plastic material.

Figure 7:
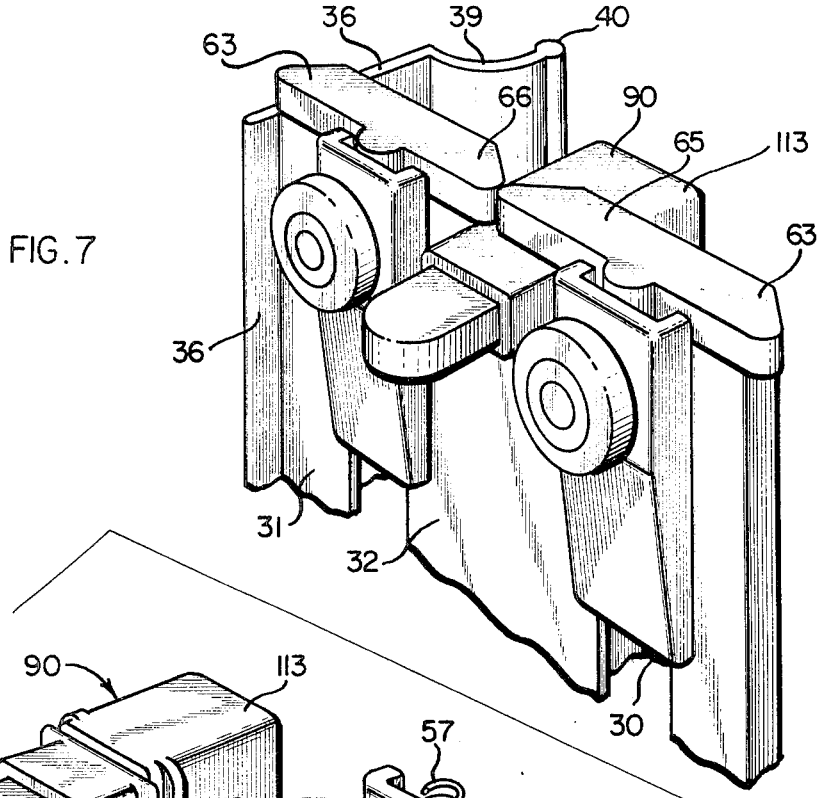
FIG. 7 shows a fragmentary, perspective view of a closure mullion and two glide assemblies and lock device installed in said closure mullion.
Figure 8:
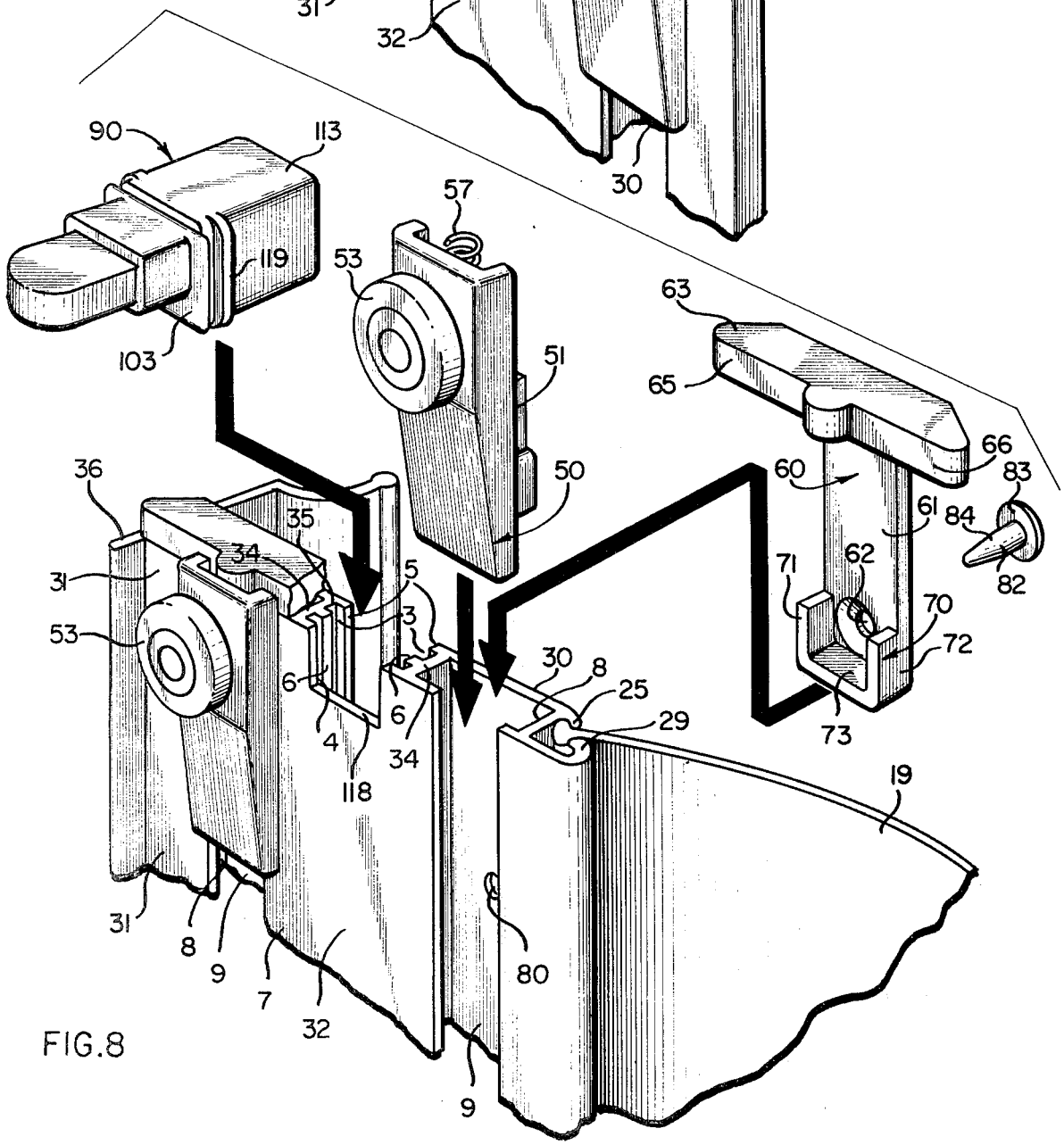
FIG. 8 shows the installation of FIG. 7 prior to the completion of the installation.

The locking device is normally positioned on basewall 7 of closure mullion 18. As shown in FIGS. 7 and 8, one end of basewall 7 of mullion 18 is notched at 118. The notch is of a size which permits locking device 90 to be inserted into the opening whereby projections 119 fit with the recess 3 formed by the flanges 5 and 6 while end wall 103 on housing section 98 fits into the recess 4 formed by flanges 6 and basewall 7.

As shown in FIGS. 2, 7, and 8 after locking device 90 is inserted in mullion 18, glide assemblies 50 are installed in adjacent channels 30, 31. When the retention member 63 of glide assembly 50 is in position in the mullion, extension arm 65 of the glide assembly in channel member 30 and retention arm 66 of glide assembly 50, which is installed in channel member 71, each extend over and seat on the top wall 113 of locking device 90 so that the locking device is maintained in its seated position in basewall 7.

As shown in FIGS. 5 and 11, track 13 is provided with a strip 150 which is disposed within a recess 131 located in the top and bottom walls 132, 133 of the track. A track 140 is formed for roller 53 by flange 134 and strip 135 which extend along the length of the track. A similar strip and track are provided in bottom track 14.

Strip 150 includes a first, elongated straight section 151, a second section 152 offset from the first section, and a lock-guide strip 153. When door 10 is moved along tracks 13, 14 to an open position, plunger arm 97 on locking device 90 will contact guide strip 153. The plunger arm 97 will retract into housing 94 until the locking device passes by the offset section 152 at which time the plunger arm will be urged outward by spring 92 and the door will be maintained in a locked biased position.

It is appreciated that the number of locking devices and rollers will vary in number depending upon the particular application. Further, the glide assemblies can be inserted on to track 13, 14 by providing an appropriate opening in track flange 134 to permit the rollers to be installed in position.

The glide assemblies and locking device can be made of any suitable material. The assemblies can be made from various plastic materials which are well known to those persons skilled in the art.

It is also appreciated that a person skilled in the art could fix colored strips of plastic or other suitable material on the front side of the mullion basewall to enhance the overall aesthetic effect of the door structure.

The foregoing detailed description has been given for clearness of understanding only, and no unnecessary limitations should be understood therefrom as modifications will be obvious to those skilled in the art.

What is claimed is:

1. A structure for use with a frame which includes top and bottom tracks, said structure being disposed within said tracks and comprising:

at least one mullion having a channel member;

a glide assembly disposed in the top and bottom of said mullion, each of said glide assemblies comprising:

a glide body having a shank and a track engaging means engageable with one of said tracks for moving said mullion along said track, said shank and track engaging means extending outwardly from opposite faces of said glide body;

a retention member which co-acts with said glide body, said retention member including an extension located at one end of said retention member and a glide body stop means located at the remaining end of said retention member;

biasing means disposed between and contacting said glide body and said retention member for biasing said glide body relative to said retention member to permit vertical movement of said glide body relative to said member;

said biasing means being free of contact with said mullion;

said glide body and retention member being disposed within said channel member; and, means for fastening said retention member to said mullion to permit movement of said glide body relative to said mullion and to permit said mullion and glide assembly to travel along said tracks.

2. A slidable door structure in accordance with claim 1 wherein said assembly includes a closure mullion, said closure mullion including a plurality of channel members and a locking device disposed within one of said channel members and retained in said channel members by said retention means.

3. A slidable door structure in accordance with claim 2 wherein said closure mullion includes a bumper wall and said frame includes a wall jamb having a sealing strip which co-acts with said bumper wall to provide a substantially watertight seal between said frame and said door structure.

4. A slidable door structure in accordance with claim 1 wherein said track means includes a roller means connected to said glide body, said roller means being adapted to move along said track.

5. A slidable door assembly in accordance with claim 1 wherein said glide body is adapted to move vertically relative to said mullion and said retention member is maintained in a fixed position in said mullion channel.

6. A slidable door assembly in accordance with claim 1 wherein said retention member includes an elongated member and an extension located at one end of said member, said extension member having at least one arm which extends outwardly from said elongated member, said arm being adapted to seat against an end of said mullion when said glide assembly is installed in said mullion.

7. A door structure in accordance with claim 2 in which said locking device includes:

a plunger housing having an opening therein;

a plunger positioned within said plunger housing and shaped to conform to said plunger housing opening to permit substantial movement of said plunger in said opening and in one direction only;

an end cap housing having a shape complementary to the shape of said plunger housing;

said end cap housing being disposed on and fastened to said plunger housing;

a plunger biasing means disposed in said end cap housing for biasing said plunger relative to said end cap housing; and, said plunger, plunger housing, end cap housing and biasing means comprising a unitary, integral locking device inserted in a mullion in a slidable door structure.

8. A glide assembly for use with a channel shaped mullion in a slidable door structure, said assembly comprising:

a glide body having a shank and a track engaging means extending from opposite faces of said glide body;

a retention member which co-acts with said glide body;

said retention member including an extension located at one end of said retention member and a glide body stop means for restricing vertical movement of said glide body located at the remaining retention member end; and, biasing means seated between said glide body and said retention member for biasing said glide body relative to said retention member to permit vertical movement of said glide body relative to said retention member;

said biasing means having two ends, one of said biasing means ends contacting said glide body and the remaining biasing means and contacting said retention member; and, fastening means for fastening the retention member to a mullion to permit movement of the glide body.

9. A glide assembly in accordance with claim 8 wherein said biasing means comprises a compression spring.

10. A glide assembly in accordance with claim 9 wherein said shank includes a bore and, upon assembly, one end of said spring is disposed within said bore and the remaining end of said spring is seated against the bottom face of said extensions.

11. A glide assembly in accordance with claim 8 wherein said extension includes at least one arm means extending outwardly from said retention member for seating on a mullion end.

12. A glide assembly for use with a mullion in which said assembly includes:

a glide body having a shank and a roller extending outwardly from opposite faces of said body;

a retention member which co-acts with said glide body, said retention member including an extension located at one end of said retention member and a glide body stop means located at the remaining end of said retention member;

a compression spring having one end thereof contacting said glide body and the remaining spring end contacting said extension;

and means for fixing said retention member to said mullion to permit movement of said glide body.

13. A glide assembly in accordance with claim 12 wherein said means for fixing said retention member to said mullion comprises a fastener adapted to fasten said retention member to said mullion.

14. A track locking device for use with a mullion in a slidable door structure to lock said door in an opened position on a track having a track lock engaging means thereon, said locking device including;

a plunger housing having an opening therein;

a plunger positioned within said plunger housing and shaped to conform to said plunger housing opening to permit substantial movement of said plunger in said opening and in one direction only;

an end cap housing having a shape complementary to the shape of said plunger housing;

said end cap housing being disposed on and fastened to said plunger housing;

a biasing means disposed in said end cap housing for biasing said plunger relative to said end cap housing; and, said plunger, plunger housing, end cap housing and biasing means comprising a unitary, integral locking device adapted to be inserted in a mullion in a slidable door structure.

15. A track locking device in accordance with claim 14 wherein said biasing means is a compression spring.

16. A track locking device in accordance with claim 14 wherein said plunger housing at least one slot located on a wall of said plunger housing and said end cap housing has at least one projection located on an inner wall face for engagement with said slot.

17. A track locking device in accordance with claim 16 and further including projection means extending from said lock device for insertion in recesses in a mullion channel.

18. A mullion for use with a slidable door structure, said mullion comprising at least one extruded, one-piece integral rigid channel shaped member, said extruded one-piece member including a basewall and a pair of spaced sidewalls;

flanges extending outward from said basewall;

each of said sidewalls being free of grooves and having an inner sidewall glide body retaining flange and an outer sidewall flange, said outer sidewall flange and said basewall flange forming a groove adapted to receive an edge of a flexible panel member;

said inner sidewall flanges serving as a retaining means for a glide body assembly;

said basewall having a retention member fastening means opening; and, said basewall and sidewalls forming a channel-shaped member for receipt of a glide body and retention member.

19. A mullion for use with a slidable door structure, said mullion comprising at least an integral, extruded, first channel member and a second channel member inverted to said first channel member;

each of said channel members including a base wall and a pair of sidewalls with a sidewall of said second channel member comprising a sidewall of said first channel members;

said basewall of one of said channel members having an elongated opening extending along the basewall commencing at one end of said basewall therein for receipt of a locking device;

said sidewalls of said channel having said basewall with an elongated opening therein, each having a pair of flanges projecting outward from said sidewall, said flanges and basewall serving as a locking device positioning means; and, said remaining channel basewall having an opening spaced from an end of said basewall for receipt of a glide assembly fastener means.

20. A mullion in accordance with claim 19 wherein said mullion further includes a bumper wall extending substantially along the length of said mullion.

21. A mullion in accordance with claim 20 and including a third channel member spaced from said first channel member and inverted to said second channel member, said third channel member having a basewall and a pair of sidewalls, one of said sidewall comprising the remaining sidewall of said second channel member, and, said third channel member basewall having an opening for receipt of a glide assembly fastener means.

* * * * *

UNITED STATES PATENT AND TRADEMARK OFFICE

CERTIFICATE OF CORRECTION

PATENT NO. : 4,256,164

DATED : March 17, 1981

INVENTOR(S) : Clarito R. Agcaoili

It is certified that error appears in the above-identified patent and that said Letters Patent are hereby corrected as shown below:

Section 4, line 64, change "56" to --59--;

Section 5, line 16, change "61" to --62--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*